US007743932B2

(12) United States Patent
Lynch

(10) Patent No.: US 7,743,932 B2
(45) Date of Patent: Jun. 29, 2010

(54) SHELF DISPLAY APPARATUS FOR ABSORBENT ARTICLES PACKAGED IN FLEXIBLE FILM

(75) Inventor: Peter Fyler Lynch, Skaneatles, NY (US)

(73) Assignee: The Procter & Gamble Company, Cincinnati, OH (US)

( * ) Notice: Subject to any disclaimer, the term of this patent is extended or adjusted under 35 U.S.C. 154(b) by 7 days.

(21) Appl. No.: 10/764,190

(22) Filed: Jan. 23, 2004

(65) Prior Publication Data

US 2005/0161418 A1 Jul. 28, 2005

(51) Int. Cl.
*A47F 5/00* (2006.01)

(52) U.S. Cl. ..... 211/184; 211/183; 211/181.1; 211/59.4

(58) Field of Classification Search ..... 211/119.003, 211/184, 175, 181.1, 126.9, 43, 42, 74, 85.31, 211/49.1, 47.7, 186, 59.3, 85.25, 85.26, 59.4; 108/27, 60, 61; 206/448, 207, 208, 209, 206/139, 523, 561, 564, 822; 220/511, 530
See application file for complete search history.

(56) References Cited

U.S. PATENT DOCUMENTS 423,647 A * 3/1890 Wells ..... 211/11
D27,604 S * 8/1897 Scott ..... D6/463
738,301 A * 9/1903 Dowd ..... 220/486
1,621,410 A * 3/1927 House ..... 211/43
2,215,208 A * 9/1940 Burkhart ..... 108/33
2,479,282 A * 8/1949 Vetesk et al. ..... 428/222
2,613,840 A * 10/1952 Coles, Jr. ..... 220/511
2,747,959 A * 5/1956 Ingelson ..... 312/140.3
2,835,406 A * 5/1958 Dickerson ..... 220/505
2,884,154 A * 4/1959 Hobson ..... 220/552
2,933,195 A * 4/1960 Radek ..... 211/153
3,439,811 A * 4/1969 Bell ..... 211/49.1
3,521,808 A * 7/1970 Weiss ..... 206/564
3,622,011 A * 11/1971 Snow ..... 248/220.41
3,669,278 A * 6/1972 Heroy ..... 211/184
3,709,452 A * 1/1973 Feeny ..... 248/220.42

(Continued)

FOREIGN PATENT DOCUMENTS

CA 974485 9/1975

(Continued)

*Primary Examiner*—Katherine W Mitchell
*Assistant Examiner*—Colleen M Quinn
(74) *Attorney, Agent, or Firm*—Charles R. Ware; William E. Gallagher

(57) ABSTRACT

A shelf display apparatus for storing absorbent articles packaged in a flexible film in a substantially upright position on a shelf. The apparatus includes a substantially horizontal top support member having a proximate end and a distal end. The apparatus includes a first vertical support member and a second vertical support. Both vertical supports being substantially vertical and both having an upper and lower end. Moreover, the first upper end is joined to the proximate end of the top support member and the first lower end is connected to a shelf. Similarly, the second upper end is joined to the distal end of the top support member and the second lower end is connected to the shelf. The top support member has a non-linear portion to provide further upright support of the packaged absorbent articles. The non-linear portion shape may consist of curves, triangles, rectangles, random patterns and combinations thereof.

2 Claims, 9 Drawing Sheets

U.S. PATENT DOCUMENTS 3,739,918 A * 6/1973 Kreitzburg ..... 211/44
3,760,744 A * 9/1973 Cruckshank ..... 108/64
3,856,137 A 12/1974 Brindley
3,857,482 A 12/1974 Shelton
3,927,761 A 12/1975 Boyle
4,013,252 A * 3/1977 Braverman ..... 248/220.41
4,018,340 A * 4/1977 Gold ..... 211/44
4,023,682 A * 5/1977 Niece ..... 211/184
4,025,039 A 5/1977 Croll et al.
4,082,046 A 4/1978 Baglin
4,143,845 A * 3/1979 Harris ..... 248/220.43
4,235,338 A 11/1980 Dugan et al.
4,288,013 A * 9/1981 Napier ..... 294/87.2
4,363,400 A 12/1982 Lewis
4,410,093 A * 10/1983 Chiariello et al. ..... 211/11
4,426,009 A * 1/1984 Pfeifer ..... 211/90.01
4,476,985 A 10/1984 Norberg et al.
4,485,922 A 12/1984 Desmond et al.
4,494,658 A 1/1985 Simon et al.
4,744,463 A 5/1988 Merzon
4,750,625 A * 6/1988 Frederick ..... 211/184
4,756,409 A 7/1988 Murray
4,762,235 A 8/1988 Howard et al.
4,832,199 A 5/1989 Rigby
4,936,460 A * 6/1990 Meyer ..... 206/524.8
4,998,631 A * 3/1991 Fridjhon ..... 211/74
5,056,668 A 10/1991 Berger
5,069,349 A 12/1991 Wear et al.
5,082,125 A * 1/1992 Ninni ..... 211/184
5,180,052 A 1/1993 Smith et al.
5,205,421 A * 4/1993 Bustos ..... 211/59.2
5,269,447 A * 12/1993 Gower et al. ..... 224/542
5,295,589 A * 3/1994 Riepl ..... 211/41.4
5,464,105 A * 11/1995 Mandeltort ..... 211/184
5,555,990 A * 9/1996 Bechstein ..... 211/59.3
5,794,796 A 8/1998 Weisburn
5,873,472 A 2/1999 Weisburn
5,913,424 A 6/1999 Kelly et al.
6,116,436 A * 9/2000 Ferrucci et al. ..... 211/187
6,152,305 A 11/2000 Green
6,227,385 B1 5/2001 Nickerson
6,234,325 B1 * 5/2001 Higgins et al. ..... 211/74
6,273,276 B1 * 8/2001 Upton et al. ..... 211/59.2
6,299,004 B1 * 10/2001 Thalenfeld et al. ..... 211/184
6,364,130 B2 * 4/2002 Wright ..... 211/41.3
6,389,991 B1 * 5/2002 Morrisson ..... 108/61
6,409,028 B2 6/2002 Nickerson
6,460,710 B1 * 10/2002 Dardashti ..... 211/184
6,622,979 B2 * 9/2003 Valiulis ..... 248/220.42
D494,394 S * 8/2004 Leong-Son et al. ..... D6/511
D495,213 S * 8/2004 Compagnucci ..... D7/601
6,889,856 B2 * 5/2005 Clark et al. ..... 211/184
6,953,118 B2 * 10/2005 Seno et al. ..... 206/764
D532,215 S * 11/2006 Calabria et al. ..... D6/462
2002/0108916 A1 8/2002 Nickerson
2003/0042214 A1 3/2003 Virvo
2003/0150830 A1 * 8/2003 Crown et al. ..... 211/175
2003/0168416 A1 * 9/2003 Morgan ..... 211/41.11
2003/0234199 A1 12/2003 Morita et al.
2004/0134822 A1 7/2004 Otsubo
2005/0121348 A1 6/2005 Clare et al.
2005/0139560 A1 * 6/2005 Whiteside et al. ..... 211/119.003

FOREIGN PATENT DOCUMENTS

CA 2313606 1/2002
EP 0 613 829 B1 9/1994
JP S07-18123 9/1932
JP 54-2852 7/1977
JP 54-26588 9/1977
JP 1996047741 A 2/1996
JP 2002095556 A 4/2002
WO WO 03/034875 A1 5/2003

* cited by examiner

SHELF DISPLAY APPARATUS FOR ABSORBENT ARTICLES PACKAGED IN FLEXIBLE FILM

FIELD OF INVENTION

The present invention relates to a shelf display apparatus for storing absorbent articles packaged in a flexible film in a substantially upright position on a shelf.

BACKGROUND OF THE INVENTION

Consumer products are commonly sold in retail stores that market such products by placing them on store shelves. Many consumer products are free-standing (e.g., cereal boxes, cans of soup) such that they do not require a support apparatus to be placed on a shelf. Other consumer products, however, are not substantially free-standing. Of these non-substantially-free-standing products, some of them require a particular orientation on the shelf (e.g., packages that have oriented surface indicia). One particular example of interest is absorbent articles (e.g., disposable diapers, sanitary napkins, tampons, and pantiliners).

Many absorbent articles are packaged in flexible film (e.g., low density polyethylene). Once packaged, the resulting package shape is generally rectangular. Such rectangular shapes typically have a larger front and rear surface which provides the most surface area for the placement of surface indicia (e.g., graphics, text, pictures). However, basic scientific principles (e.g., center of gravity) dictate that the rectangular shape package is most stabile when placed on one of these larger surfaces. Thus, the surface indicia is not seen by the consumer, especially when one package is stacked on top of another (see the prior art example in FIG. 1; a variety of absorbent articles 800 are shown). If the consumer cannot find their desired product on the shelf amongst a multitude of stacked packages, then they are less likely to purchase the proper product for their particular application, thus resulting in potential dissatisfaction with the entire brand. Furthermore, when consumers search through several stacks of products to find their desired selection, they are more likely to mix the product versions with one another. Consequently, the shopping experience of subsequent consumer is worsened. In addition to the consumers' frustrations, the store clerk has similar difficulties when attempting to determine reorder amounts and proper product placement.

What is needed is a shelf display apparatus to store absorbent articles which are packaged in a flexible film in a substantially upright position. Such an apparatus would present these packages in a better orientation resulting in improved product identification for both the consumer and store clerk.

SUMMARY OF THE INVENTION

A shelf display apparatus for storing absorbent articles packaged in a flexible film in a substantially upright position on a shelf. The apparatus includes a substantially horizontal top support member having a proximate end and a distal end. The apparatus also includes a first vertical support member and a second vertical support. Both vertical supports being substantially vertical and both having an upper and lower end. Moreover, the first upper end is joined to the proximate end of the top support member and the first lower end is connected to a shelf. Similarly, the second upper end is joined to the distal end of the top support member and the second lower end is connected to the shelf.

The top support member has a non-linear portion to provide further upright support of the packaged absorbent articles. The non-linear portion may extend any length of the top support member. The non-linear portion has a shape selected from the group consisting of curves, triangles, rectangles, random patterns and combinations thereof.

The apparatus may also include a first fastening mechanism that is joined to the first lower end of the first vertical support member. The first fastening mechanism connects the apparatus to the shelf. The first fastening mechanism may be a substantially horizontal bottom plate and at least one fastener, wherein the bottom plate may be substantially parallel and juxtapose to the shelf, wherein said fastener securely joins the bottom plate to the shelf. Alternatively, the first fastening mechanism may be a U-shaped bracket that is partially inserted through the shelf. Alternatively, the first fastening mechanism may be an engaging member that is inserted through a receiving area of a shelf threshold of the shelf.

Similarly, the apparatus may also include a second fastening mechanism that is joined to the second lower end of the second vertical support member. The second fastening mechanism connects the apparatus to the shelf. The second fastening mechanism may be a substantially horizontal bottom plate and at least one fastener, wherein the bottom plate may be substantially parallel and juxtapose to the shelf, wherein said fastener securely joins the bottom plate to the shelf. Alternatively, the second fastening mechanism may be a U-shaped bracket that is partially inserted through the shelf. Alternatively, the second fastening mechanism may be an engaging member that is inserted through a receiving area of a shelf threshold of the shelf.

The apparatus may also include a substantially solid wall that is subjacent to the top support member and interdisposed between the first vertical support member and second vertical support member. The wall provides additional support and facilitates the handling of said apparatus for placement on the shelf.

The absorbent articles may be selected from the group consisting of disposable diapers, sanitary napkins, tampons, and pantiliners.

All documents cited are, in relevant part, incorporated herein by reference; the citation of any document is not to be construed as an admission that it is prior art with respect to the present invention.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify like elements and numbers with the same final two digits indicate corresponding elements among embodiments, wherein:

DETAILED DESCRIPTION OF THE INVENTION

Reference will now be made in detail to various exemplary embodiments of the invention, several of which are also illustrated in the accompanying drawings.

Figure 1:
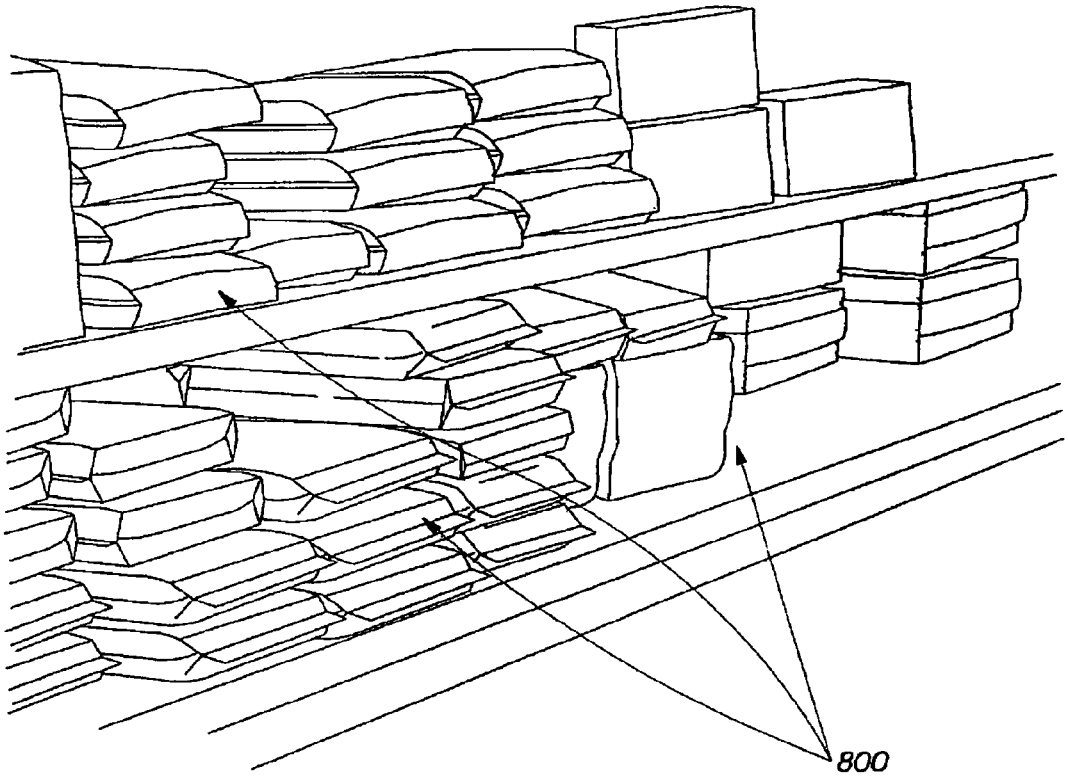
Fig. 1 (Prior Art)
FIG. 1 is a perspective view of the prior art, wherein, packaged absorbent articles are stacked on top of one another resulting in a confusing display arrangement for the store clerk and the consumer.
Figure 2:
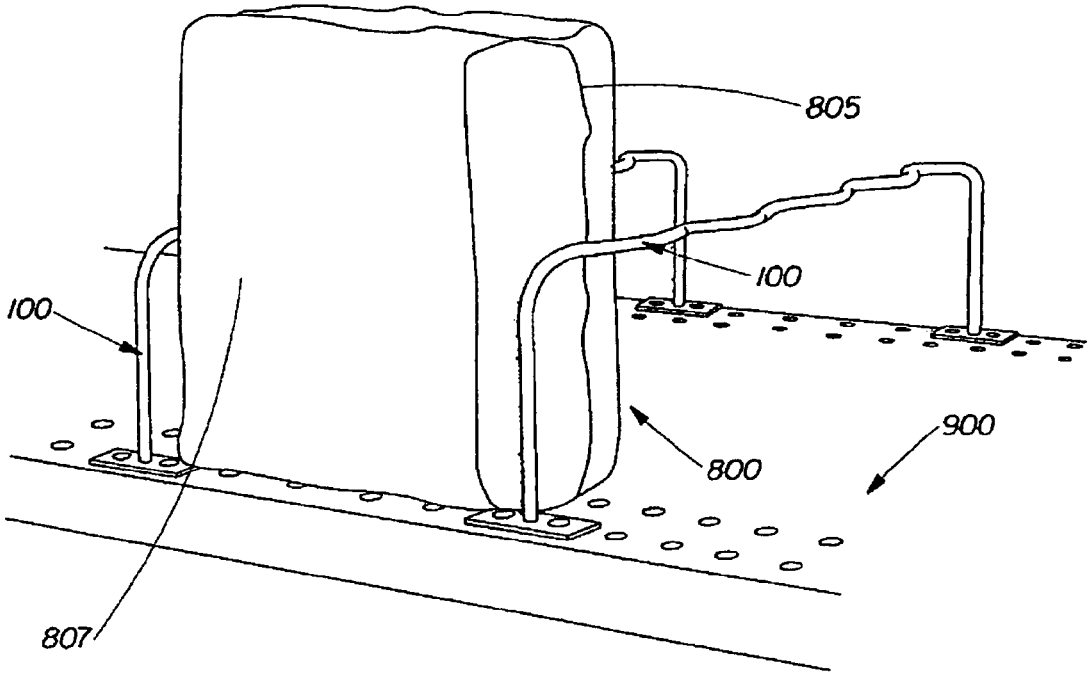
FIG. 2 is a perspective view of a first embodiment of a shelf display apparatus in accordance with the present invention, wherein, a packaged absorbent article is held in a substantially upright position on a store shelf such that the surface indicia is readily discernible to the store clerk and to the consumer.

FIG. 2 depicts a non-limiting, exemplary, first embodiment of a shelf display apparatus 100 which is adapted to store absorbent articles 800 which are packaged in a flexible film 805 (hereinafter together referred to "packages") on a store shelf 900. Packages 800 are typically substantially rectangular in shape and have surface indicia on at least one of its major surface area sides 807. Preferably, apparatus 100 is adapted to store packages 800 such that major surface area side 807 having surface indicia is facing towards the direction of the consumer (e.g., front of shelf 900).

Figure 3:
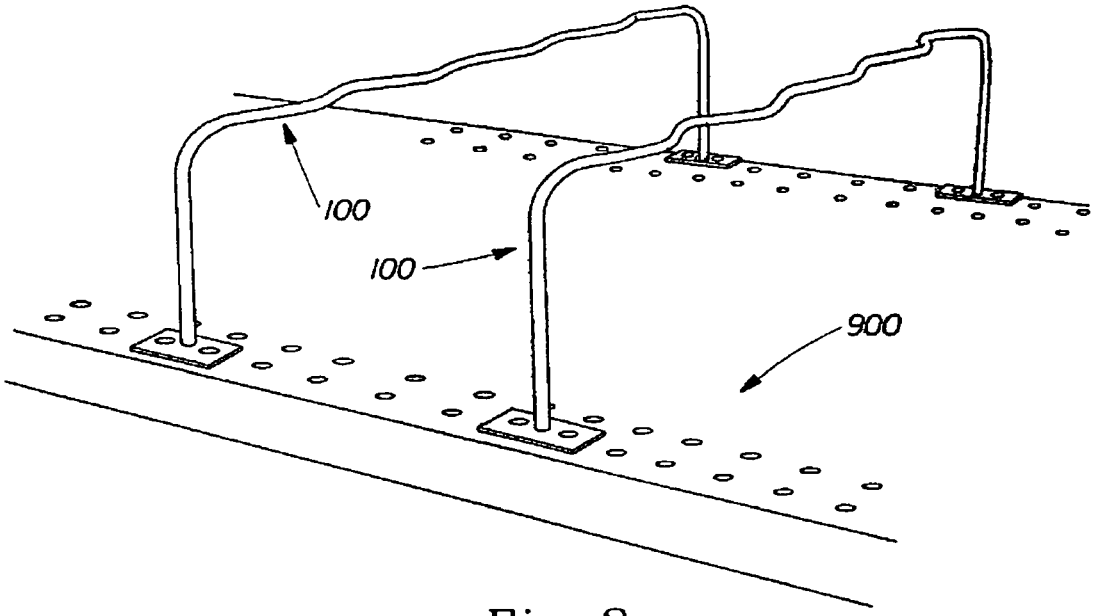
FIG. 3 is a perspective view of the apparatus in FIG. 2, wherein, the packaged absorbent article has been removed to clearly depict the shelf display apparatus connected to the store shelf.
Figure 4:
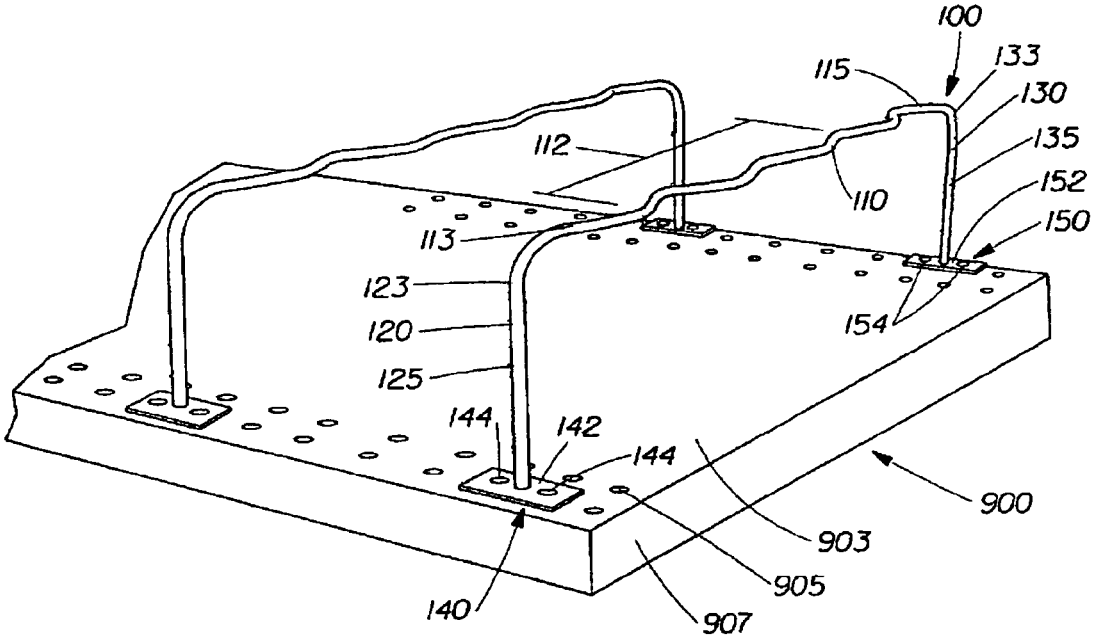
FIG. 4 is a perspective view of the first embodiment in FIG. 3.
Figure 5:
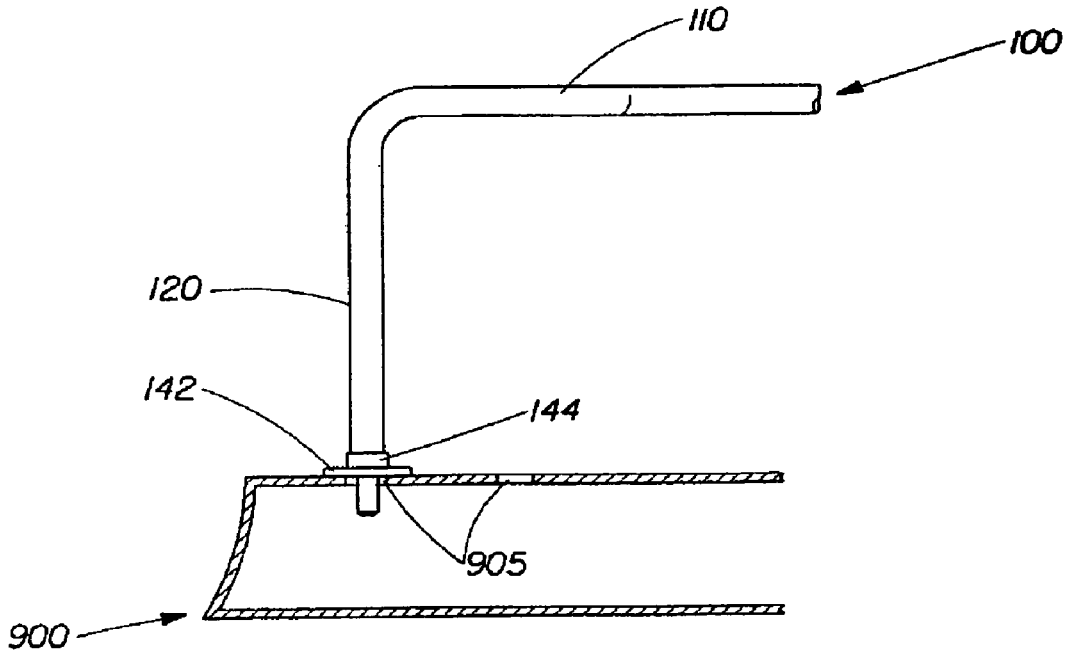
FIG. 5 is a right side elevational view of a portion of the apparatus in FIG. 4, wherein, the mechanical connection between the fastening mechanism and the store shelf is shown.

FIGS. 3-5 further depict apparatus 100 having a substantially horizontal top support member 110. Top support member 110 having a proximate end 113 and a distal end 115. Top support member 110 being vertically supported by a first vertical support member 120 and a second vertical support member 130. More specifically, said first vertical support member 120 has a first upper end 123 and a first lower end 125, wherein said first upper end 123 is joined to proximate end 113 of top support member 110 and wherein said first lower end 125 is connected to shelf 900. Similarly, second vertical support member 130 has a second upper end 133 and a second lower end 135, wherein said second upper end 133 is joined to the distal end 115 of top support member 110 and wherein the second lower end 135 is connected to the shelf 900.

Together, top support member 110, first vertical support member 120 and second vertical support member 130 provide a support structure for orienting and storing packages 800 in a substantially upright position on a store shelf 900. Furthermore, top support member 110 may have a non-linear portion 112 that helps keep packages 800 from falling longitudinally along shelf 900 and into an adjacent absorbent article, thus reducing the risk of a resulting domino effect of falling packages. One skilled in the art would appreciate that the non-linear portion 112 may extend any portion of the length of top support member 110, including substantially the entire length. One skilled in the art would also appreciate that the non-linear shape may take upon any shape or form including, but not limited to, curves (shown herein), triangles, rectangles, random patterns, etc. and combinations thereof.

A first fastening mechanism 140 and a second fastening mechanism 150 are provided to attach apparatus 100 to store shelf 900. More specifically, first fastening mechanism 140 may have a substantially horizontal bottom plate 142 and fastener 144, wherein, bottom plate 142 may be substantially parallel and juxtapose to store shelf 900 and fastener 144 securely joins said bottom plate 142 to said store shelf 900.

Store shelf 900 has a shelf surface 903 on which the apparatus 100 and packages 800 are placed. Further, store shelf 900 may have holes 905 in which fastener 144 is connected through and into (or through) shelf body region 907. While a store shelf 900 having a substantially hollow body region 907 is shown in the present application, one skilled in the art would appreciate that body region 907 may be substantially solid and indentations, rather than holes 905, may be used to receive fastener 144. Second fastening mechanism 150 may be substantially identical to said first fastening mechanism 140, wherein, a similar bottom plate 152 and fastener 154 may be used. However, one skilled in the art would also appreciate that first fastening mechanism 140 and second fastening mechanism 150 may be different and not necessarily combinations of the various fasteners described herein.

Figure 6:
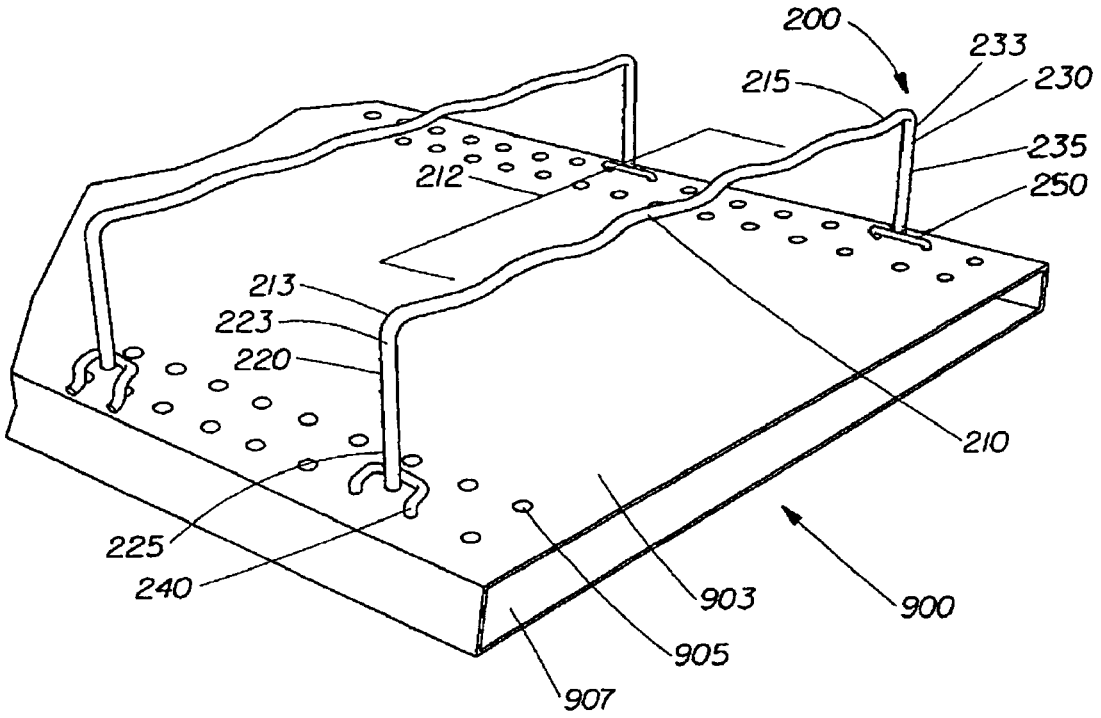
FIG. 6 is a perspective view of a second embodiment of a shelf display apparatus in accordance with the present invention.
Figure 7:
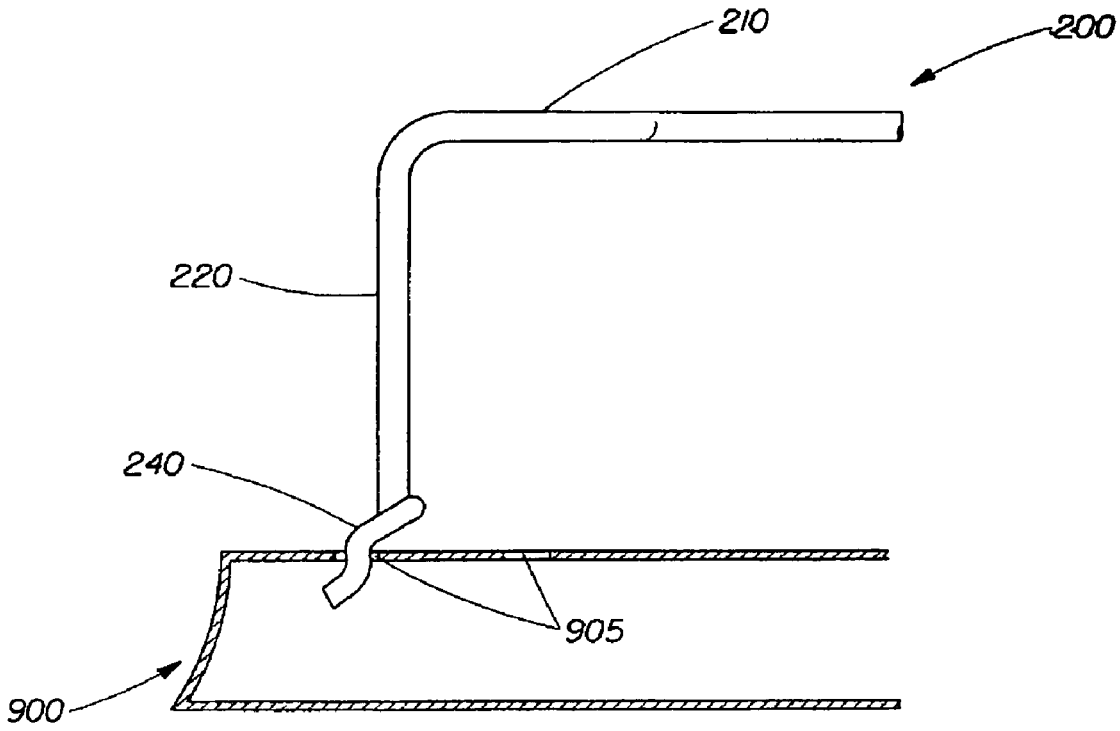
FIG. 7 is a right side elevational view of a portion of the apparatus in FIG. 6, wherein, the mechanical connection between the fastening mechanism and the store shelf is shown.

FIGS. 6-7 depict a non-limiting, exemplary, second embodiment of a shelf display apparatus 200 which is adapted to store packages (not shown) on a store shelf 900. Apparatus 200 may have a top support member 210 having a proximate end 213 and a distal end 215. Top support member 210 being vertically supported by a first vertical support member 220 and a second vertical support member 230. More specifically, said first vertical support member 220 has a first upper end 223 and a first lower end 225, wherein said first upper end 223 is joined to proximate end 213 of top support member 210 and wherein said first lower end 225 is connected to shelf 900. Similarly, second vertical support member 230 has a second upper end 233 and a second lower end 235, wherein said second upper end 233 is joined to the distal end 215 of top support member 210 and wherein the second lower end 235 is connected to the shelf 900.

Together, top support member 210, first vertical support member 220 and second vertical support member 230 provide a support structure for orienting and storing packages 800 in a substantially upright position on a store shelf 900. Furthermore, top support member 210 may have a non-linear portion 212 that helps keep packages 800 from falling longitudinally along shelf 900 and into an adjacent absorbent article, thus reducing the risk of a resulting domino effect of falling packages. One skilled in the art would appreciate that the non-linear portion 212 may extend any portion of the length of top support member 210, including substantially the entire length. One skilled in the art would also appreciate that the non-linear shape may take upon any shape or form including, but not limited to, curves (shown herein), triangles, rectangles, random patterns, etc. and combinations thereof.

A first fastening mechanism 240 and a second fastening mechanism 250 are provided to attach apparatus 200 to store shelf 900. More specifically, first fastening mechanism 240 may be a U-shaped bracket that is partially inserted through holes 905 (or indentations as discussed supra) to provide vertical support of the first vertical support member 220. Second fastening mechanism 250 may be substantially identical to said first fastening mechanism 240, wherein, a similar U-shaped bracket may be used. However, one skilled in the art would also appreciate that first fastening mechanism 240 and second fastening mechanism 250 may be different and not necessarily combinations of the various fasteners described herein.

Figure 8:
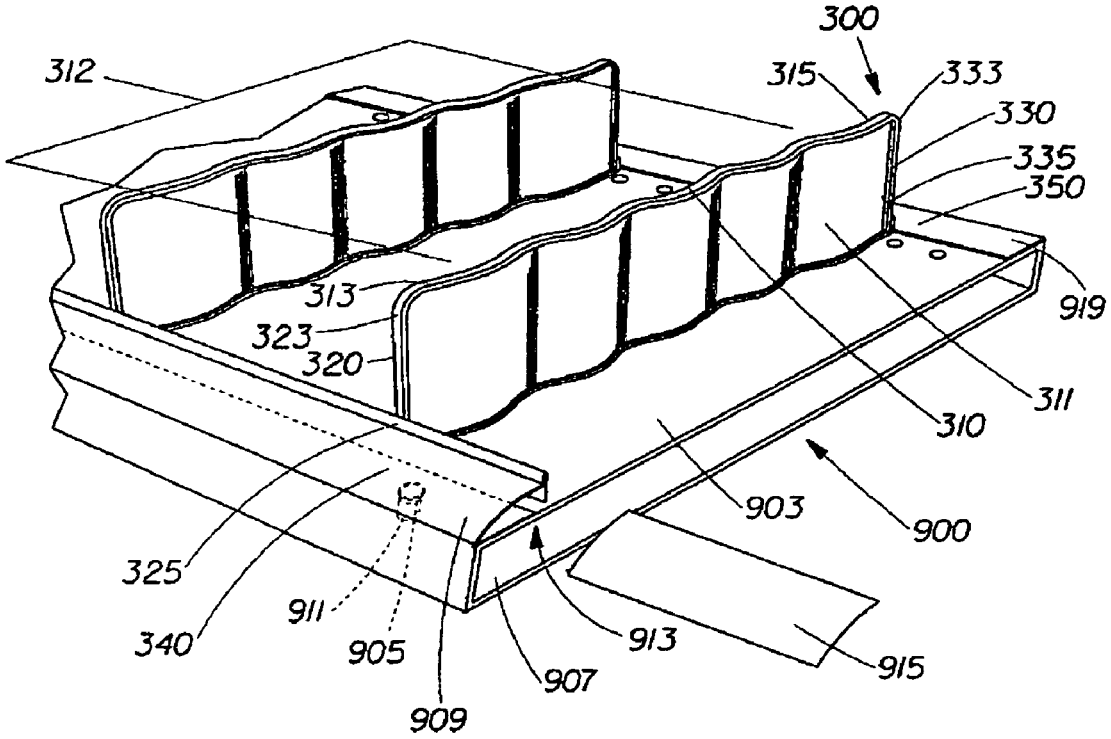
FIG. 8 is a perspective view of a third embodiment of a shelf display apparatus in accordance with the present invention.
Figure 9:
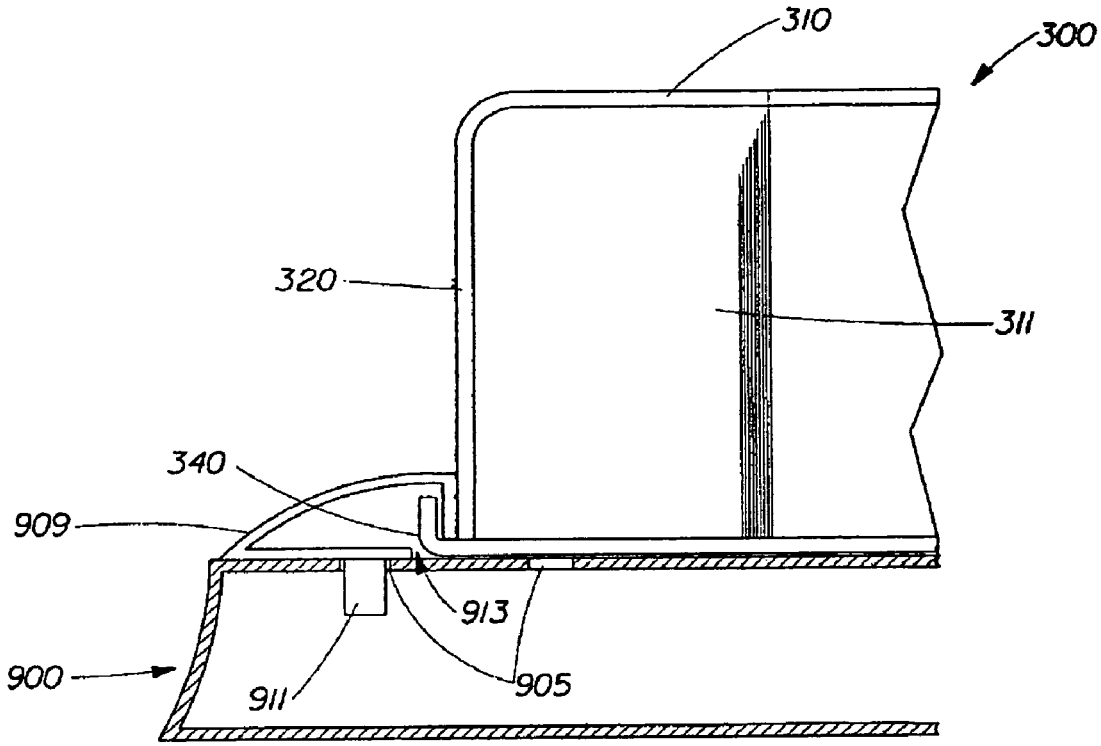
FIG. 9 is a right side elevational view of a portion of the apparatus in FIG. 8, wherein, the mechanical connection between the fastening mechanism and the store shelf is shown.

FIGS. 8-9 depict a non-limiting, exemplary, third embodiment of a shelf display apparatus 300 which is adapted to store packages (not shown) on a store shelf 900. While similar in construction to the first and second embodiment, apparatus 300 may also incorporate a substantially solid wall 311 that helps provide additional structural support and facilitates the handling of said apparatus for placement on shelf 900. Similarly, apparatus 300 may have a top support member 310 having a proximate end 313 and a distal end 315. Top support member 310 being vertically supported by a first vertical support member 320 and a second vertical support member 330. More specifically, said first vertical support member 320 has a first upper end 323 and a first lower end 325, wherein said first upper end 323 is joined to proximate end 313 of top support member 310 and wherein said first lower end 325 is connected to shelf 900. Similarly, second vertical support member 330 has a second upper end 333 and a second lower end 335, wherein said second upper end 333 is joined to the distal end 315 of top support member 310 and wherein the second lower end 335 is connected to the shelf 900.

Together, top support member 310, first vertical support member 320, second vertical support member 330 and wall 311 provide a support structure for orienting and storing packages 800 in a substantially upright position on a store shelf 900. Furthermore, top support member 110 and wall 311 may have a non-linear portion 112 that helps keep packages 800 from falling longitudinally along shelf 900 and into an adjacent absorbent article, thus reducing the risk of a resulting domino effect of falling packages. One skilled in the art would appreciate that the non-linear portion 112 may extend any portion of the length of top support member 110 and wall 311, including substantially the entire length. One skilled in the art would also appreciate that the non-linear shape may take upon any shape or form including, but not limited to, curves (shown herein), triangles, rectangles, random patterns, etc. and combinations thereof.

A first fastening mechanism 340 and a second fastening mechanism 350 are provided to attach apparatus 300 to store shelf 900. More specifically, first fastening mechanism 340 may be an engaging member that is inserted through a receiving area 913 of a shelf threshold 909 to provide vertical support of the first vertical support member 320. Shelf threshold 909 may be an integral portion of shelf 900 or it may be attached to said shelf by a shelf attachment mechanism 911 through holes (or indentations) 905. Additionally, an advertisement 915 (such as a card or label) may be inserted into or affixed onto shelf threshold 909 such that a variety of product information may be communicated to the store clerk and/or consumer (e.g., brand name, size, type, quantity, quality, price, discounts, shelf stocking minimums, re-supply warehouse location, etc.). Second fastening mechanism 350 may be substantially identical to said first fastening mechanism 340, wherein, a similar engaging member may be used. However, one skilled in the art would also appreciate that first fastening mechanism 340 and second fastening mechanism 350 may be different and not necessarily combinations of the various fasteners described herein. Additionally, first and second mechanism 350 may be a single, integral part which runs longitudinally along shelf 900 to help provide additional structural support and facilitate the alignment and insertion of apparatus 300 for placement on shelf 900. Lastly, apparatus 300 may have a rear threshold that is not necessarily adapted for use of an advertisement card or label, particularly when the rear side of the shelf is not immediately visible.

The shelf display apparatus contemplated herein may be made of any suitable manner that provides sufficient rigidity for its intended purpose including, but not limited to, steel, aluminum, plastic, etc.

While the advantages of the present invention may certainly be appreciated on a store shelf, the present invention may also be appreciated at other locations where storing packages in this manner may be desired (e.g., consumer's home).

While package 800 typically takes the shape of substantially rectangular, one skilled in the art would appreciate that other shapes (e.g., trapezoidal) may be used with the present invention, as exampled in co-pending applications WO 01/68022A1 (filed Mar. 10, 2000, published Sep. 9, 2001) and U.S. Ser. No. 10/423,425 (filed on Apr. 25, 2003, claiming priority of May 28, 2002). Additionally, the present invention may prove especially useful for packages of absorbent articles where the absorbent articles are not highly compacted in the flexible film such that the package is not substantially free-standing, as exampled in co-pending applications WO 01/68022A1 (filed Mar. 10, 2000, published Sep. 9, 2001).

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A store display, comprising:

a shelf having a shelf surface lying along a substantially horizontal plane, and having a plurality of engageable features at a plurality of locations along said surface;

first and second shelf display apparatuses, each apparatus resting downwardly upon said shelf, and comprising:

a first vertical support member having a first lower end, wherein said first lower end is engaged with a first of said engageable features at a first engagement location, such that movement of said first lower end within said horizontal plane is blocked as a result of said engagement;

a second vertical support member having a second lower end, wherein said second lower end is engaged with a second of said engageable features at a second engagement location, such that movement of said second lower end within said horizontal plane is blocked as a result of engagement between said second lower end and said second of said engageable features, said first and second engagement locations being spaced apart from each other in said horizontal plane; and a lateral support member having a length that is spaced above said horizontal plane, said length joining said first and second vertical support members, and a non-linear portion along the length, said nonlinear portion having a plurality of horizontally extending portions that at least partially extend in one or more horizontal directions away from a line connecting said first and second vertical support members, said first and second shelf display apparatuses being disposed along said shelf, with said respective lateral support members in spaced apart, facing relationship;

at least one package containing articles, said package being disposed between said lateral support members, said package being formed of flexible film and being substantially rectangular in shape, having a pair of substantially opposite major surfaces and first and second pairs of substantially opposite lesser surfaces, one of said first pair of lesser surfaces resting on said shelf, and each of said second pair of lesser surfaces respectively contacting one of said respective facing lateral support members, said lateral support members providing horizontal, two-dimensional support to said package such that said package is held in a substantially upright position on said shelf with said major surfaces oriented substantially vertically relative to said horizontal plane.

2. A store display, comprising:

a shelf having a shelf surface lying along a substantially horizontal plane, and having a plurality of engageable features at a plurality of locations along said surface;

first and second shelf display apparatuses, each apparatus resting downwardly upon said shelf, and comprising:

a first vertical support member having a first lower end, wherein said first lower end is engaged with a first of said engageable features at a first engagement location, such that movement of said first lower end within said horizontal plane is blocked as a result of said engagement;

a second vertical support member having a second lower end, wherein said second lower end is engaged with a second of said engageable features at a second engagement location, such that movement of said second lower end within said horizontal plane is blocked as a result of engagement between said second lower end and said second of said engageable features, said first and second engagement locations being spaced apart from each other in said horizontal plane; and a lateral support member having a length that is spaced above said horizontal plane, said length joining said first and second vertical support members, and a nonlinear portion along the length, said nonlinear portion having a plurality of horizontally extending portions that at least partially extend in one or more horizontal directions away from a line connecting said first and second vertical support members, said first and second shelf display apparatuses being disposed along said shelf, with said respective lateral support members in spaced apart, facing relationship;

at least one package containing articles, said package being disposed between said lateral support members of said first and second shelf apparatuses, said package being formed of flexible film and having an outer surface, a first portion of said outer surface contacting said lateral support member of said first shelf display apparatus, a second portion of said outer surface contacting said lateral support member of said second shelf display apparatus, and a third portion of said outer surface resting on said shelf, said lateral support members providing horizontal, two-dimensional support to said package such that said package is held in a substantially upright position on said shelf.

* * * * *